US008921700B2

(12) United States Patent
VandenEynden et al.

(10) Patent No.: US 8,921,700 B2
(45) Date of Patent: Dec. 30, 2014

(54) SOLID CORE GLASS BEAD SEAL WITH STIFFENING RIB

(71) Applicant: Emerson Electric Co., St. Louis, MO (US)

(72) Inventors: Brian VandenEynden, Loveland, OH (US); Prasad S. Khadkikar, Shenzhen (CN); Scott Schuckmann, Maineville, OH (US); Jian Sun, Mason, OH (US); Gabe Lakner, Mason, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 13/924,689

(22) Filed: Jun. 24, 2013

(65) Prior Publication Data

US 2013/0284496 A1 Oct. 31, 2013

Related U.S. Application Data

(63) Continuation of application No. 12/555,899, filed on Sep. 9, 2009, now Pat. No. 8,487,187.

(51) Int. Cl.
*H01B 17/30* (2006.01)

(52) U.S. Cl.
CPC ..... *H01B 17/30* (2013.01); *H01B 17/305* (2013.01)
USPC ..... 174/152 GM; 174/50.61; 174/650; 174/262; 361/302

(58) Field of Classification Search
USPC ..... 174/152 GM, 50.61, 50.5, 50.55, 50.63, 174/650, 262, 520, 527; 361/306.2, 328, 361/329, 306.1, 302; 607/37; 439/935
See application file for complete search history.

(56) References Cited

U.S. PATENT DOCUMENTS

| | | | | |
|---|---|---|---|---|
| 5,041,019 | A | 8/1991 | Sharp et al. | |
| 5,866,851 | A * | 2/1999 | Taylor et al. | 174/152 GM |
| 5,905,627 | A * | 5/1999 | Brendel et al. | 361/302 |
| 6,037,539 | A | 3/2000 | Kilgo et al. | |
| 6,114,633 | A * | 9/2000 | Duhancik | 174/152 GM |
| 6,275,369 | B1 | 8/2001 | Stevenson et al. | |
| 6,529,103 | B1 | 3/2003 | Brendel et al. | |
| 6,586,675 | B1 * | 7/2003 | Bealka et al. | 174/50.56 |
| 6,632,104 | B2 * | 10/2003 | Quadir | 439/587 |
| 6,661,168 | B1 | 12/2003 | Hartley et al. | |
| 6,768,629 | B1 | 7/2004 | Allen et al. | |
| 6,831,529 | B1 | 12/2004 | Devoe et al. | |
| 7,046,499 | B1 * | 5/2006 | Imani et al. | 361/302 |
| 7,123,440 | B2 | 10/2006 | Albrecht et al. | |
| 7,144,274 | B2 | 12/2006 | Taylor | |
| 7,182,640 | B2 * | 2/2007 | Garrett et al. | 439/587 |

(Continued)

FOREIGN PATENT DOCUMENTS

| | | |
|---|---|---|
| JP | S51-100847 | 8/1976 |
| JP | 2006-324229 | 11/2006 |
| WO | WO 2009086435 A2 * | 7/2009 |

*Primary Examiner* — Angel R Estrada
(74) *Attorney, Agent, or Firm* — Harness, Dickey & Pierce, P.L.C.

(57) ABSTRACT

A hermetic feed-through includes a housing body defining a hollow space, a plurality of conductive pins and a seal structure. The plurality of conductive pins extend through the hollow space. The seal structure is provided in the hollow space and includes a single-piece glass component. The single-piece glass component hermetically seals at least two conductive pins to the housing body and electrically insulates the at least two conductive pins from the housing body.

18 Claims, 4 Drawing Sheets

(56) References Cited

U.S. PATENT DOCUMENTS

| | | | | |
|---|---|---|---|---|
| 7,745,725 | B2 | 6/2010 | Paterek et al. | |
| 8,082,663 | B1 * | 12/2011 | Monroe et al. | 174/50.61 |
| 2003/0096162 | A1 | 5/2003 | Lasater et al. | |
| 2003/0139096 | A1 | 7/2003 | Stevenson et al. | |
| 2008/0060834 | A1 | 3/2008 | Eck et al. | |

* cited by examiner

SOLID CORE GLASS BEAD SEAL WITH STIFFENING RIB

CROSS-REFERENCE TO RELATED APPLICATIONS

This application is a continuation of U.S. patent application Ser. No. 12/555,899 filed on Sep. 9, 2009. The entire disclosure of the above application is incorporated herein by reference.

FIELD

The present disclosure relates to hermetically-sealed electrical multi-pin feed-throughs having glass compression seals.

BACKGROUND

The statements in this section merely provide background information related to the present disclosure and may not constitute prior art.

Referring to FIG. 1, a conventional multi-pin feed-through 10 of the type having a compression seal and designed for use in a hermetically sealed electric device includes a metal housing 11 and a plurality of conductive pins 16. The metal housing 11 includes a peripheral portion 12 and a central portion 14. The central portion 14 defines a plurality of apertures to receive associated conductive pins 16. A plurality of glass beads 18 are inserted into the plurality of apertures and fused to the conductive pins 16 and the central portion 14 to provide an airtight bond. The resulting glass-to-metal seal hermetically seals the associated conductive pins 16 to the central portion 14.

A conventional multi-pin feed-through similar to that shown in FIG. 1 is disclosed in U.S. Pat. No. 7,123,440 ("the '440 patent"). See, e.g., FIGS. 3A and 3B of the '440 patent. As disclosed in the '440 patent, the feed-through 10 may be mounted to a hermetically sealed device (not shown in FIG. 1) such as a hard disk drive, for example, so that one of the ends of the conductive pins 16 are located inside the hermetically sealed device and others of the ends of the conductive pins 16 are located outside the hermetically sealed device.

In manufacturing the typical feed-through of FIG. 1, positioning the large number (for example, twenty-eight) of conductive pins 16 and their associated glass beads 18 relative to the central portion 14 of the metal housing 11 is difficult and time-consuming. Further, the sizes of the individual glass beads 18 are limited by the spacing between the conductive pins 16 and the walls of the apertures. If a conductive material is undesirably trapped in the individual glass beads 18 during the manufacturing process, the trapped conductive material may adversely affect the electrical insulation of the conductive pins 16 from the metal insert 14 due to the short distance therebetween.

SUMMARY

This section provides a general summary of the disclosure, and is not a comprehensive disclosure of its full scope or all of its features.

In one form, a hermetic feed-through includes a housing body defining a hollow space, a plurality of conductive pins extending through the hollow space, and a seal structure. The seal structure is provided in the hollow space and includes a single-piece glass component for hermetically sealing at least two conductive pins to the housing body. The seal structure electrically insulates the at least two conductive pins from the housing body and from each other.

In another form, a hermetic feed-through includes a housing body, a first group of a plurality of conductive pins, a second group of a plurality of conductive pins, a bridge member, a first single-piece glass component, and a second single-piece glass component. The housing body defines an elongated hollow space and includes a pair of longitudinal walls extending along a longitudinal direction of the housing body and a pair of end walls extending along a transverse direction perpendicular to the longitudinal direction. The first group of conductive pins and the second group of conductive pins pass through the elongated hollow space. The bridge member extends across the hollow space in the transverse direction and separates the first group of conductive pins from the second group of conductive pins. The first single-piece glass component defines a plurality of apertures corresponding to the first group of conductive pins and seals the first group of conductive pins to the bridge member and the housing body. The second single-piece glass component defines a plurality of apertures corresponding to the second group of conductive pins and seals the second group of conductive pins to the bridge member and the housing body. The first single-piece glass component and the second single-piece glass component are aligned along the longitudinal direction of the housing body. The end walls are thinner than the longitudinal walls.

In still another form, a hermetic feed-through includes a hollow housing body, a plurality of groups of conductive pins, and a plurality of single-piece glass components. The plurality of groups of conductive pins extend through the hollow housing body, each group including at least two conductive pins. The plurality of single-piece glass components correspond to the plurality of groups of conductive pins for sealing a corresponding one of the plurality of groups of conductive pins to the housing body. The plurality of single-piece glass components are aligned along a longitudinal direction of the hollow housing body. A plurality of bridge members separate two adjacent ones of the plurality of single-piece glass components.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 is a perspective view of a prior art feed-through;

Corresponding reference numerals indicate corresponding parts throughout the several views of the drawings.

DETAILED DESCRIPTION

Example embodiments will now be described more fully with reference to the accompanying drawings.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Figure 1:
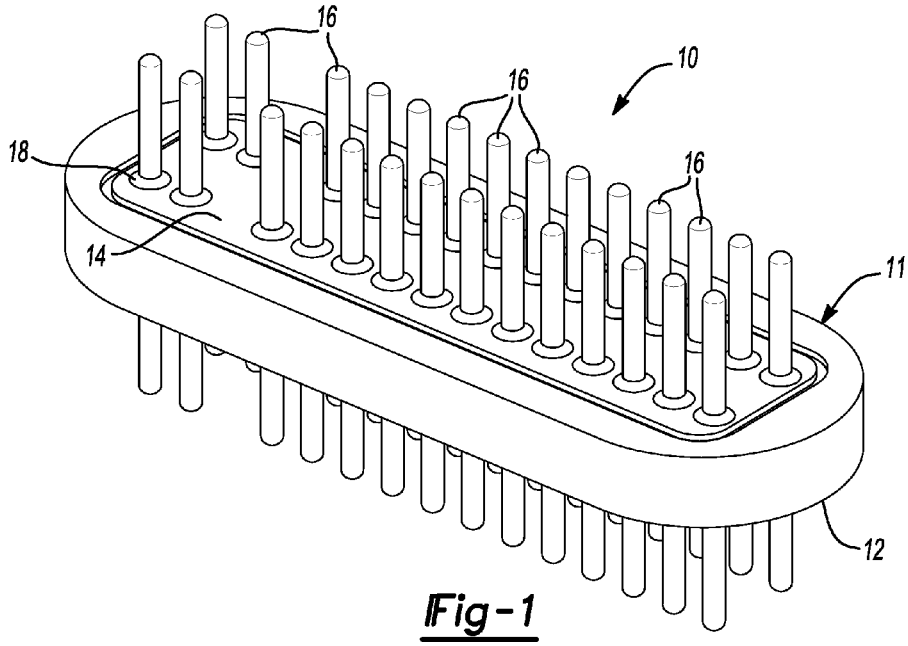
Fig-1 PRIOR ART
Figure 2:
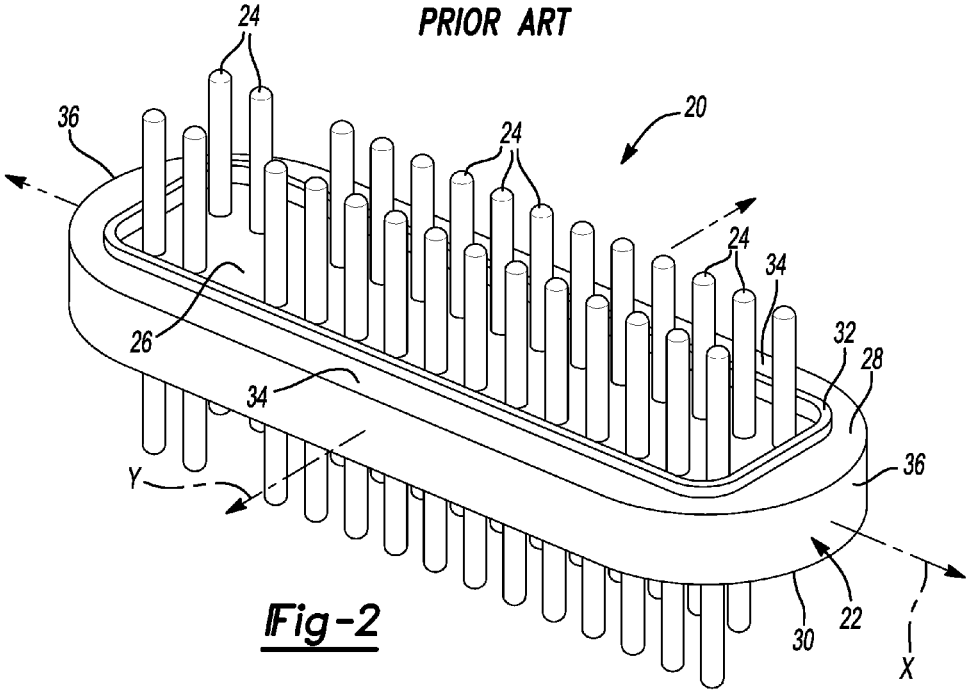
FIG. 2 is a perspective view of a feed-through according to a first embodiment of the present disclosure.
Figure 3:
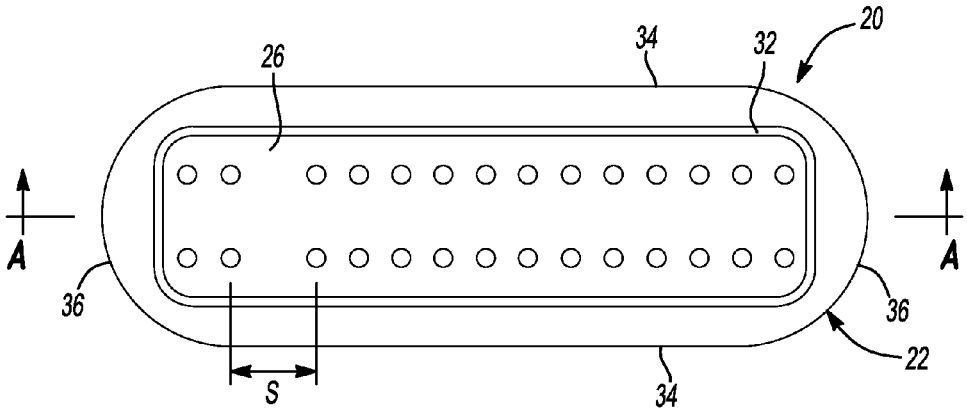
FIG. 3 is a top view of a feed-through according to a second embodiment of the present disclosure.
Figure 4:
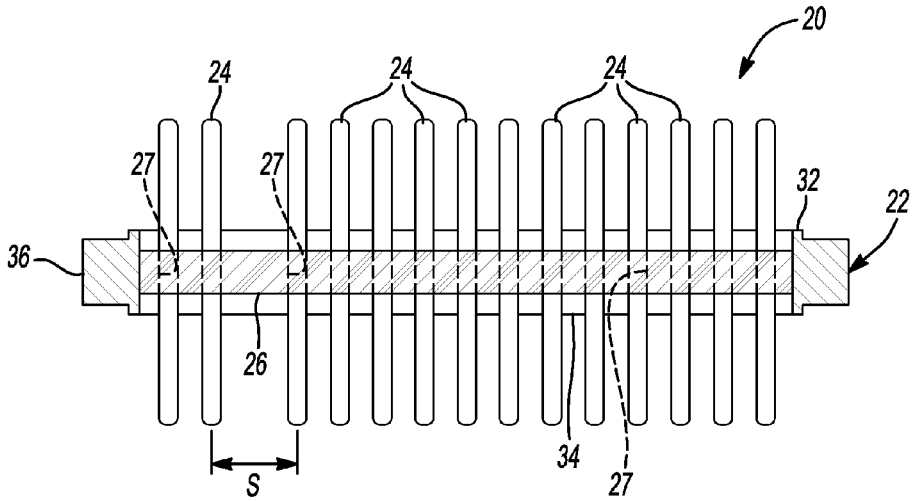
FIG. 4 is a cross-sectional view of a feed-through taken along line A-A of FIG. 3.

Referring to FIGS. 2 to 4, a hermetic feed-through 20 according to a first embodiment of the present disclosure includes a metallic housing body 22, a plurality of conductive pins 24, and a seal structure 26 for hermetically sealing the plurality of conductive pins 24 to the metallic housing body 22.

The housing body 22 may be made of cold-rolled steel and plated with electrolytic nickel. The housing body 22 defines an elongated shape along a longitudinal direction X. For example only, the elongated shape has a high aspect ratio, i.e., length to width. The housing body 22 defines an elongated hollow space extending along the longitudinal direction X. The housing body 22 includes a first surface 28 and a second surface 30 opposite to the first surface 28. A peripheral flange 32 is formed around an inner periphery of the housing body 22 and extends outwardly and vertically from the first surface 28 and the second surface 30. The feed-through 20 may be mounted to a hermetically sealed device (not shown), for example, a hard disk drive (see, e.g., the '440 patent). One of the ends of the conductive pins 24 are located inside the hermetically sealed device and the other ends of the conductive pins 24 are located outside the hermetically sealed device. The housing body 22 includes a pair of longitudinal walls 34 extending along the longitudinal direction X, and a pair of end walls 36 extending in a transverse direction Y perpendicular to the longitudinal direction X.

The plurality of conductive pins 24 passes through the hollow space and are hermetically sealed by the seal structure 26 to an inner peripheral surface of the housing body 22. The conductive pins 24 may be made of an electrically conductive metal material. Additionally, the conductive pins 24 may be plated with a metal, such as copper, gold, silver, platinum, or palladium to improve the electrical performance of the conductive pins 24; depending upon the particular plating metal, plating may be accomplished either before or after the conductive pins 24 are sealed to the housing body 22. The conductive pins 24 provide for the transfer of electrical power or signal from outside the hermetically sealed device to the inside of the hermetically sealed device.

In the illustrative example, twenty-eight conductive pins 24 are provided and are arranged in two rows along the longitudinal direction X of the housing body 22. The conductive pins 24 are spaced at a constant interval except for four conductive pins 24 adjacent to one of the end walls 36 of the housing body 22. The four conductive pins 24 are separated from the other two four conductive pins 24 by a spacing S. When the conductive pins 24 have a diameter of 0.46 mm, the distance between the conductive pins 24 and an adjacent wall (i.e., longitudinal wall 34 or end wall 36) of the housing body 22 is at least 0.5 mm.

The seal structure 26 is a single-piece glass component in the form of a glass bead that defines a plurality of preformed apertures 27 through which the corresponding plurality of conductive pins 24 pass. The seal structure 26 is sealed to an inner peripheral surface of the housing body 22. The housing body 22 is generally inserted into an opening of the hermetically sealed device and welded (or the like) to adjacent walls of the hermetically sealed device. Therefore, the design of the housing 22 is constrained by the shape and size of the opening provided in the hermetically sealed device into which it will be installed. Due to the design constraints of the housing 22, the design of the seal structure 26 is also constrained. Generally, the seal structure 26 in a feed-through for an application such as the hard disk drive disclosed in the '440 patent may have an aspect ratio (i.e., length/width ratio) of at least about 1:1 to about 3.8:1, and generally not greater than 4:1, if a single-piece seal structure is desired.

The seal structure 26 includes sealing glass materials well known in the art. For example, sealing glass materials are generally available from Fusite (a division of Emerson Electric Company, the assignee and owner of this patent application), Schott A G, and Corning Incorporated. Optionally, the sealing glass materials may include one or more non-reactive additives that serve as a mechanical strengthening agent and serves to increase fracture toughness of the seal structure 26, thereby reducing likelihood of cracking during thermal cycling. One such additive is alumina.

The feed-through 20 allows for easy insertion of the conductive pins 24 in the seal structure 26 by using a single-piece glass component in the hollow space to seal all conductive pins 24 to the housing body 22. Therefore, disorientation of the conductive pins 24 relative to the housing body 22 may be prevented. Moreover, using one single-piece glass component to replace twenty-eight glass components reduces assembly time and consequently manufacturing costs.

Figure 5:
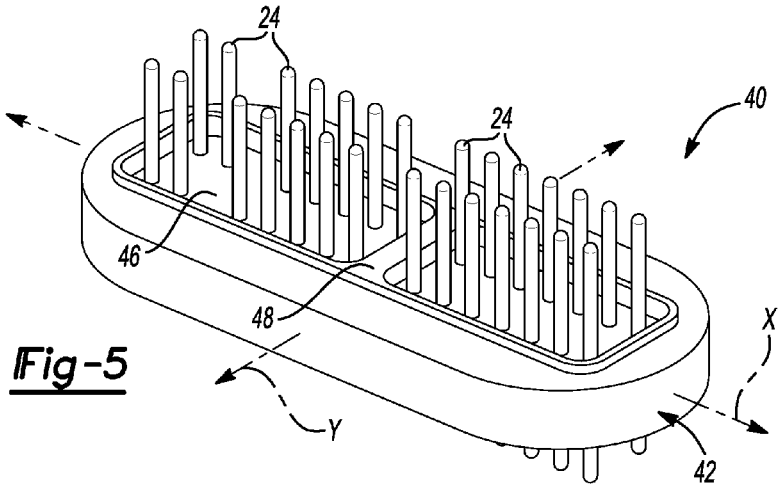
FIG. 5 is a perspective view of a feed-through according to a second embodiment of the present disclosure.
Figure 6:
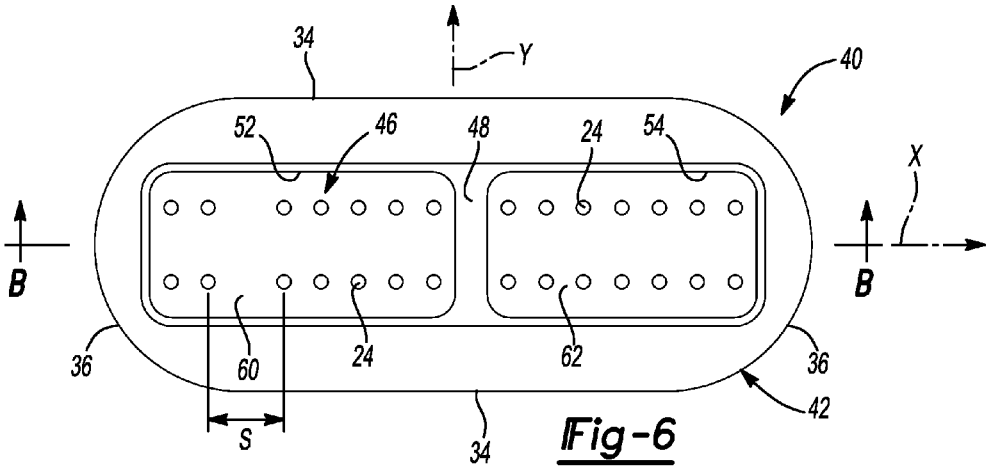
FIG. 6 is a top view of a feed-through according to a second embodiment of the present disclosure.
Figure 7:
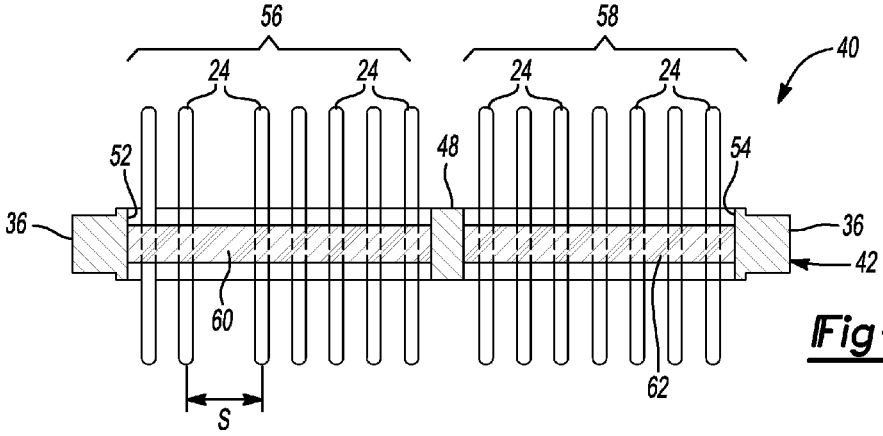
FIG. 7 is a cross-sectional view of a feed-through taken along line B-B of FIG. 6.

Referring to FIGS. 5 to 7, a hermetic feed-through 40 according to a second embodiment of the present disclosure includes a metallic housing body 42, a plurality of conductive pins 24, and a seal structure 46. The hermetic feed-through 40 is similar to that of the first embodiment except for the provision of a bridge member 48, and the structure of the seal structure. Similar reference numbers will be used to refer to similar components and the description thereof is omitted for clarity.

More specifically, the housing body 42 includes a bridge member 48 provided across the hollow space and extends along the transverse direction Y perpendicular to the longitudinal direction X to divide the hollow space into a first receiving space 52 and a second receiving space 54. The bridge member 48 is provided close to a middle portion of the housing body 22. Therefore, the first receiving space 52 and the second receiving space 54 are approximately of equal size.

The conductive pins 24 may be divided into a first group 56 and a second group 58, each group including fourteen conductive pins 24. The first group 56 is inserted through the first receiving space 52 and the second group 58 is inserted through the second receiving space 54.

The seal structure 46 includes a first seal part 60 and a second seal part 62 arranged along the longitudinal direction X. The first seal part 60 and a second seal part 62 each are formed as a single-piece glass component in the form a glass bead. As in the first embodiment, the seal structure 46 may be loaded with alumina additives to improve fracture toughness of the seal structure 46 to reduce likelihood of cracking. The first seal part 60 and the second seal part 62 each define preformed apertures to allow the conductive pins 24 to pass through. The first seal part 60 and the second seal part 62 hermetically seal the first group 56 and the second group 58 of conductive pins 24, respectively, to the housing body 42 and the bridge member 48. The first seal part 60 and the second seal part 62 also electrically insulate the first and second groups 56 and 58 of conductive pins 24, respectively, from the housing body 42 and the bridge member 48.

The seal structure 46 in combination of the bridge member 48 is particularly advantageous in a housing body that defines a hollow space having a relatively high aspect ratio, for example, an aspect ratio exceeding 3.8:1. A hollow space having a relatively high aspect ratio requires a glass seal with a relatively high aspect ratio if a single glass bead for sealing all conductive pins 24 is desired. In compression glass seals, thermal cracks are possible in the seal structure 46 that has a relatively high aspect ratio due to exposure to fluctuating temperatures.

In a feed-through with an elongated compression glass seal structure, the seal structure 46 receives different stresses along the longitudinal direction X and along the transverse direction Y. When the difference between the stresses in the longitudinal direction X and in the transverse direction Y is significant, cracks may occur, particularly in areas of the seal structure with a relatively high aspect ratio. For example, stress difference may be significant in areas between the longitudinal walls 34 and their adjacent conductive pins 24. Cracks may occur adjacent to or tangential to the outer peripheries of the conductive pins 24 in these areas.

Therefore, by providing a bridge member 48 across the housing body 42, the aspect ratio of the glass structure 46 in the region between the conductive pins 24 and the housing body 42 is reduced. The difference between the tensile stresses in the longitudinal direction X and in the transverse direction Y is also reduced. Therefore, the likelihood of generating thermal cracks can be reduced. The feed-though 40 of the second embodiment can withstand extended thermal cycles. For example, the hermetic feed-through of the present disclosure may withstand over 100 thermal cycles at temperatures from −40° C. to 80° C. and maintain hermeticity to $1\times10^{-9}$ cc/sec He.

Figure 8:
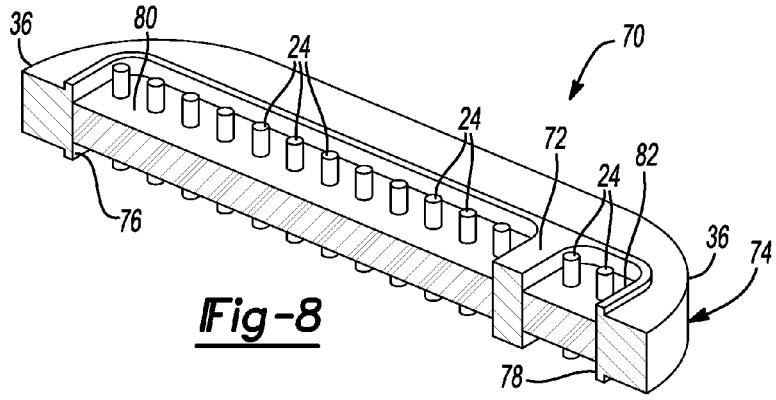
FIG. 8 is a partial cross-sectional perspective view of a feed-through according to a third embodiment of the present disclosure.

Referring to FIG. 8, a hermetic feed-through 70 according to a third embodiment of the present disclosure has a structure similar to that of the hermetic feed-through 40 of the second embodiment, differing in the position of the bridge member. The hermetic feed-through 70 of the third embodiment includes an off-center bridge member 72, which is disposed close to one of the end walls 36.

Referring back to FIGS. 2 to 4, a larger spacing S is formed between four conductive pins 24 adjacent to one of the end walls 36 and the remaining twenty-four conductive pins 24. The bridge member 72 of the third embodiment may be formed in the spacing S.

As shown in FIG. 8, the bridge member 72 divides the hollow space of a housing body 74 into a first receiving space 76 and a second receiving space 78. The first receiving space 76 is larger than the second receiving space 78 to receive more conductive pins 24 than the second receiving space 78. For example, in the illustrative example, twenty-four conductive pins 24, designated as a first group, are received in the first receiving space 76 and four conductive pins 24, designated as a second group, are received in the second receiving space 78.

A first seal part 80 and a second seal part 82 hermetically seal the first group and the second group of conductive pins 24, respectively, to the housing body 74 and the bridge member 72. The first seal part 80 and the second seal part 82 each are formed as a single-piece glass component in the form of a single glass bead.

Figure 9:
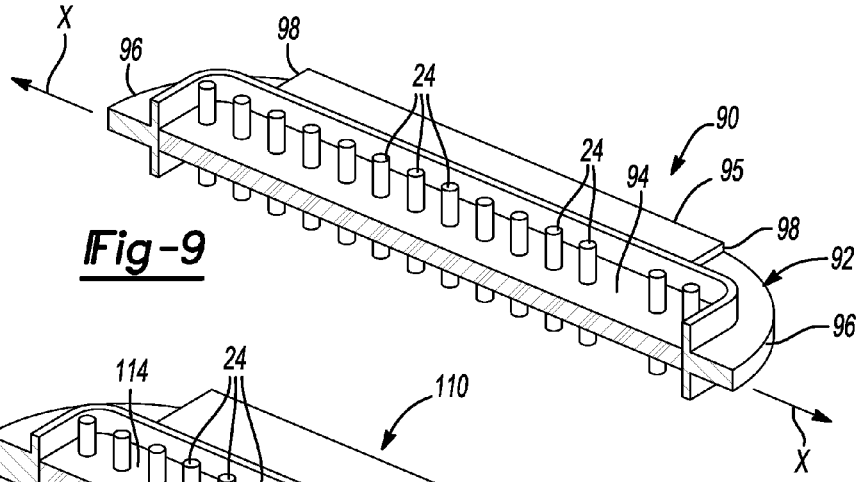
FIG. 9 is a partial cross-sectional perspective view of a feed-through according to a fourth embodiment of the present disclosure.

Referring to FIG. 9, a hermetic feed-through 90 according to a fourth embodiment of the present disclosure includes a modified housing body 92, a single glass component 94 and a plurality of conductive pins 24. The modified housing body 92 differs from the housing bodies of the first to third embodiments in that the modified housing body 92 has longitudinal walls and end walls of uneven thickness. The modified housing body 92 includes a pair of longitudinal walls 95 extending along a longitudinal direction X of the housing body 92 and a pair of end walls 96 connecting the opposing ends 98 of the longitudinal walls 94. The end walls 96 are thinner than the longitudinal walls 95.

As previously described, cracks may occur in a seal structure when it is subjected to different stresses in its longitudinal direction X and its transverse direction Y. In a glass-to-metal seal that is a compression seal, stresses are generated in the seal structure as a result of a difference in thermal expansion rates between the housing body and the seal structure. The housing body, which is made from metal, has a coefficient of thermal expansion greater than that of the seal structure, which may be made from glass as described in the present disclosure. When the aspect ratio of the seal structure is 1:1, the longitudinal and transverse stresses in the seal structure are about the same. As the aspect ratio of the seal structure increases from 1:1, the tensile stress in the transverse direction Y creates a susceptibility to cracking.

Referring again to FIG. 9, the feed-through 90 addresses the desire to balance the longitudinal and transverse stresses in the seal structure of a high aspect ratio feed-through. By reducing the thickness of the housing body 112 at its end walls 96 the compressive stress in the seal structure in those areas is correspondingly reduced. As a result, the variation between the longitudinal and transverse stresses in the seal structure is reduced or eliminated. The modified housing body 92 reduces the likelihood of generating cracks in the seal structure and thus allows for the use of a single glass component with a relatively large aspect ratio to seal all conductive pins 24.

Figure 10:
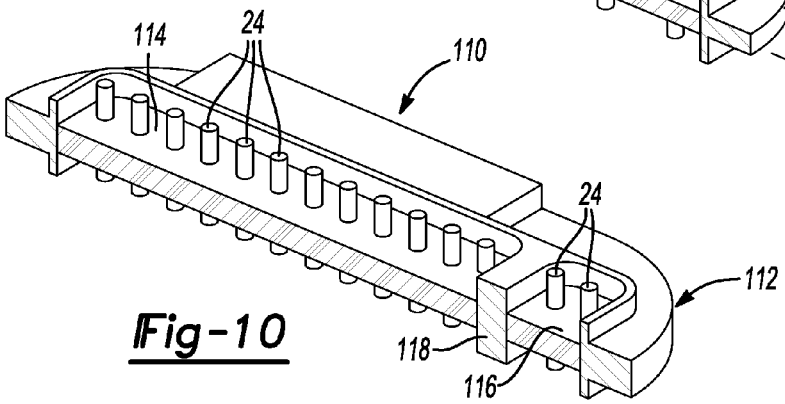
FIG. 10 is a partial cross-sectional perspective view of a feed-through according to a fifth embodiment of the present disclosure.

Referring to FIG. 10, a hermetic feed-through 110 according to a fifth embodiment of the present disclosure includes an off-center bridge member 72 similar to that of FIG. 8 and a modified housing body 92 similar to that of FIG. 9.

More specifically, the hermetic feed-through 110 includes a housing body 112, a plurality of conductive pins 24, a seal structure having a first seal portion 114 and a second seal portion 116, and a bridge member 118 located between the first seal portion 114 and the second seal portion 116. The housing body 112 has longitudinal walls that are shorter than those in FIG. 9. The hermetic feed-through 90 of the fifth embodiment has the advantages of the bridge member and a thinner end wall, as previously described in connection with the second embodiment, and the fourth embodiment.

Figure 11:
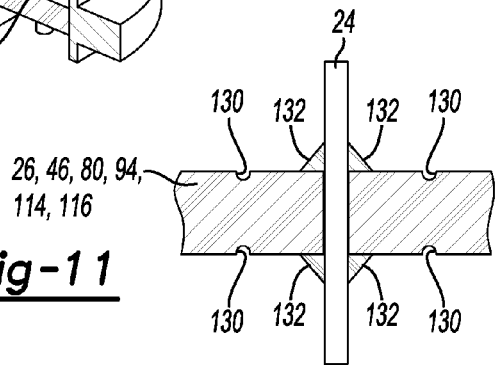
FIG. 11 is a partial schematic view of a conductive pin and a seal structure.

Referring to FIG. 11, to further reduce the likelihood of generation of thermal cracks in the seal glass, the surface of the glass seal structure 26, 46, 80, 94, 114, 116 may be provided with recessed portions 130 in any of the embodiments described above. The recessed portions 130 function as stress relief to alleviate the effect of irregular thermal stress. Additionally, a coating layer 132 may be provided around each of the conductive pins 24 and on the surface of the seal structure to increases the strength of the glass seal structure 26, 46, 80, 94, 114, 116.

It is understood and appreciated that while only one bridge member has been described in connection with the second, third, and fifth embodiments, more than one bridge member can be provided along the transverse direction Y to further reduce the aspect ratio of glass seal structure.

This description is merely exemplary in nature and, thus, variations that do not depart from the gist of the disclosure are intended to be included within the scope of the disclosure. Further areas of applicability of the present invention will become apparent from the detailed description provided hereinafter. It should be understood that the description and specific examples, while indicating the preferred embodiments of the invention, are intended for purposes of illustration only and are not intended to limit the scope of this disclosure.

The invention claimed is:

1. A hermetic feed-through comprising:

a housing having a length extending in a longitudinal direction and a width extending in a lateral direction, the length being greater than the width, and an opening through the housing, the opening being elongated in the longitudinal direction, and a peripheral flange that is located about the opening;

a plurality of conductive pins extending through the opening; and a glass seal completely filling the opening and hermetically sealing each of the plurality of conductive pins to the housing and electrically isolating each of the conductive pins from the housing and from one another;

the glass seal comprising a single-piece glass component formed from a glass bead that defines a plurality of preformed apertures through which corresponding ones of the plurality of conductive pins are passed and having a surface comprising a recessed portion; and wherein the glass seal has a length to width aspect ratio of at least 1.8:1.

2. The hermetic feed-through of claim 1, wherein the glass seal has a length to width aspect ratio of not greater than 4:1.

3. The hermetic feed-through of claim 1, wherein the glass seal has a length to width aspect ratio of about 3.8:1.

4. The hermetic feed-through of claim 1, wherein the plurality of conductive pins are divided into a first group comprising more than one conductive pin and a second group comprising more than one conductive pin; and wherein the first group and second group are spaced apart from one another along the longitudinal direction.

5. The hermetic feed-through of claim 1, wherein the housing further comprises two side walls extending in the longitudinal direction and spaced-apart from one another in a lateral direction and two end walls extending between the side walls and spaced-apart from one another in the longitudinal direction;

wherein the side walls have a first thickness and the end walls have a second thickness less than the first thickness.

6. The hermetic feed-through of claim 1, further comprising a coating on an exterior surface the glass seal.

7. The hermetic feed-through of claim 6, wherein the coating is on an exterior surface of at least one conductive pin.

8. A hard disk drive comprising the hermetic feed-through of claim 1.

9. A hermetic feed-through comprising:

a housing comprising two longitudinally extending side walls, two laterally extending end walls, the side walls have a first thickness and the end walls have a second thickness less than the first thickness, an opening passing through the housing, a bridge member transversely extending across the opening, and a flange adjacent to a perimeter of the opening;

a plurality of conductive pins extending through the opening; and a glass seal structure hermetically sealing each of the plurality of conductive pins to the housing and electrically isolating each of the conductive pins from the housing and from one another;

wherein the glass seal structure comprises a glass bead that defines a plurality of preformed apertures corresponding to the plurality of conductive pins; and wherein the glass seal structure has a length to width aspect ratio of about 1.8:1 to about 4:1.

10. The hermetic feed-through of claim 9, wherein the glass seal structure has a length to width aspect ratio of not greater than 4:1.

11. The hermetic feed-through of claim 9, wherein the glass seal structure has a length to width aspect ratio of about 3.8:1.

12. The hermetic feed-through of claim 9, wherein the plurality of conductive pins are divided into a first group comprising at least two conductive pins and a second group comprising at least two conductive pins; and wherein the first group and second group are separated from one another in the longitudinal direction.

13. The hermetic feed-through of claim 9, wherein the glass seal structure further comprises a surface including a recessed portion.

14. The hermetic feed-through of claim 9, further comprising a coating on an exterior surface of the glass seal structure.

15. The hermetic feed-through of claim 14, further comprising the coating on an exterior surface of at least one conductive pin.

16. A hard disk drive comprising the hermetic feed-through of claim 9.

17. A hermetic feed-through comprising:

a body comprising an opening and a bridge member extending generally transversely across the opening and dividing the opening into a first receiving space and a second receiving space;

a plurality of first conductive pins extending through the first receiving space;

at least one second conductive pin extending through the second receiving space;

a hermetic glass seal structure sealing each of the first and second conductive pins to the body and electrically isolating each of the first and second conductive pins from the body and one another; and wherein the seal structure is formed by a first glass component disposed in the first receiving space and comprising a plurality of preformed apertures corresponding to the plurality of first conductive pins and second glass component disposed in the second receiving space and comprising at least one preformed aperture corresponding to the at least one second conductive pin.

18. A hard disk drive comprising the hermetic feed-through of claim 17.

* * * * *